US008973662B2

(12) United States Patent
Xu et al.

(10) Patent No.: US 8,973,662 B2
(45) Date of Patent: Mar. 10, 2015

(54) DOWNHOLE DEBRIS REMOVAL TOOL CAPABLE OF PROVIDING A HYDRAULIC BARRIER AND METHODS OF USING SAME

(75) Inventors: Yang Xu, Houston, TX (US); Ying Qing Xu, Tomball, TX (US); Gregory L. Hern, Porter, TX (US)

(73) Assignee: Baker Hughes Incorporated, Houston, TX (US)

( * ) Notice: Subject to any disclaimer, the term of this patent is extended or adjusted under 35 U.S.C. 154(b) by 259 days.

(21) Appl. No.: 13/528,910

(22) Filed: Jun. 21, 2012

(65) Prior Publication Data

US 2013/0341017 A1 Dec. 26, 2013

(51) Int. Cl.
*E21B 31/08* (2006.01)

(52) U.S. Cl.
USPC ..... 166/312; 166/99; 166/105.1; 166/107; 166/169

(58) Field of Classification Search
CPC ..... E21B 27/00; E21B 27/005; E21B 27/04; E21B 37/00; E21B 31/06; E21B 31/03
USPC ..... 166/99, 105.1, 105.4, 107, 311, 312, 166/162–169, 177.7
See application file for complete search history.

(56) References Cited

U.S. PATENT DOCUMENTS

| | | | | |
|---|---|---|---|---|
| 1,279,333 | A * | 9/1918 | Green | 166/222 |
| 1,623,543 | A * | 4/1927 | Jones et al. | 166/99 |
| 1,656,526 | A * | 1/1928 | Lincoln | 175/308 |
| 2,556,849 | A * | 6/1951 | Nolley et al. | 166/66.5 |
| 2,787,327 | A | 4/1957 | Pearson et al. | |
| 2,797,755 | A * | 7/1957 | Bobo | 175/312 |
| 2,819,038 | A * | 1/1958 | Eckel | 175/99 |
| 2,834,300 | A * | 5/1958 | Brock | 166/99 |
| 2,894,725 | A | 7/1959 | Baker | |
| 2,912,227 | A * | 11/1959 | Baker | 175/312 |
| 3,023,810 | A | 3/1962 | Anderson | |
| 3,102,600 | A * | 9/1963 | Jackson | 175/308 |
| 3,106,526 | A * | 10/1963 | Schmidt | 210/188 |
| 3,118,510 | A * | 1/1964 | Woods et al. | 175/308 |
| 3,198,256 | A * | 8/1965 | Kirby, II | 166/99 |
| 3,332,497 | A | 7/1967 | Page, Jr. | |
| 3,360,048 | A | 12/1967 | Watkins | |
| 3,500,933 | A | 3/1970 | Burba, Jr. et al. | |
| 3,814,180 | A * | 6/1974 | Oliver | 166/99 |

(Continued)

FOREIGN PATENT DOCUMENTS

| | | |
|---|---|---|
| CN | 2883658 Y | 3/2007 |
| GB | 2348226 A | 9/2000 |

(Continued)

OTHER PUBLICATIONS

Dictionary definition of "barrier", accessed Apr. 30, 2014 via thefreedictionary.com.*

(Continued)

*Primary Examiner* — Blake Michener
(74) *Attorney, Agent, or Firm* — Steve Rosenblatt

(57) ABSTRACT

A downhole tool for removing debris from a wellbore comprises a body having a bore, a collection member, and a means for creating a hydraulic barrier within a wellbore annulus. The hydraulic barrier within the wellbore annulus restricts upward movement of a debris laden fluid within the wellbore annulus causing the debris laden fluid to be directed toward the collection member. Thus, the hydraulic barrier facilitates removal of debris from the wellbore.

10 Claims, 1 Drawing Sheet

(56) References Cited

U.S. PATENT DOCUMENTS

| | | | | |
|---|---|---|---|---|
| 3,856,355 | A * | 12/1974 | Grable | 299/8 |
| 3,907,047 | A * | 9/1975 | Thompson et al. | 175/312 |
| 4,059,155 | A | 11/1977 | Greer | |
| 4,060,140 | A * | 11/1977 | Barrington | 175/7 |
| 4,111,262 | A * | 9/1978 | Duncan | 166/99 |
| 4,217,966 | A | 8/1980 | Garrett | |
| 4,276,931 | A | 7/1981 | Murray | |
| 4,335,788 | A | 6/1982 | Murphey et al. | |
| 4,390,064 | A | 6/1983 | Enen, Jr. et al. | |
| 4,515,212 | A | 5/1985 | Krugh | |
| 4,588,243 | A | 5/1986 | Ramsey et al. | |
| 4,828,026 | A | 5/1989 | Nelson | |
| 4,857,175 | A | 8/1989 | Spinnler | |
| 4,880,059 | A | 11/1989 | Brandell et al. | |
| 5,228,518 | A | 7/1993 | Wilson et al. | |
| 5,295,537 | A * | 3/1994 | Trainer | 166/105.1 |
| 5,425,424 | A | 6/1995 | Reinhardt et al. | |
| 5,524,709 | A | 6/1996 | Withers | |
| 5,533,373 | A | 7/1996 | Plester | |
| 5,682,950 | A * | 11/1997 | Bjørnstad | 166/99 |
| 5,735,356 | A * | 4/1998 | Boulard | 175/21 |
| 6,112,812 | A | 9/2000 | Carter | |
| 6,176,311 | B1 * | 1/2001 | Ryan | 166/99 |
| 6,179,057 | B1 | 1/2001 | Fontana et al. | |
| 6,202,752 | B1 | 3/2001 | Kuck et al. | |
| 6,276,452 | B1 | 8/2001 | Davis et al. | |
| 6,341,653 | B1 | 1/2002 | Firmaniuk et al. | |
| 6,352,129 | B1 | 3/2002 | Best | |
| 6,361,272 | B1 | 3/2002 | Bassett | |
| 6,397,959 | B1 | 6/2002 | Villarreal | |
| 6,427,776 | B1 | 8/2002 | Hoffman et al. | |
| 6,446,737 | B1 | 9/2002 | Fontana et al. | |
| 6,543,538 | B2 | 4/2003 | Tolman et al. | |
| 6,568,475 | B1 | 5/2003 | Grubb et al. | |
| 6,607,031 | B2 | 8/2003 | Lynde et al. | |
| 6,655,459 | B2 | 12/2003 | Mackay | |
| 6,719,071 | B1 | 4/2004 | Moyes | |
| 6,755,256 | B2 | 6/2004 | Murley et al. | |
| 6,951,251 | B2 | 10/2005 | Penisson | |
| 7,069,992 | B2 | 7/2006 | Lewis et al. | |
| 7,096,975 | B2 | 8/2006 | Aronstam et al. | |
| 7,114,581 | B2 | 10/2006 | Aronstam et al. | |
| 7,174,975 | B2 | 2/2007 | Krueger et al. | |
| 7,267,172 | B2 | 9/2007 | Hofman | |
| 7,472,745 | B2 * | 1/2009 | Lynde et al. | 166/99 |
| 7,478,687 | B2 | 1/2009 | Lynde et al. | |
| 7,497,260 | B2 | 3/2009 | Telfer | |
| 7,513,303 | B2 | 4/2009 | Hern | |
| 7,610,957 | B2 | 11/2009 | Davis et al. | |
| 7,721,822 | B2 | 5/2010 | Krueger et al. | |
| 7,753,113 | B1 | 7/2010 | Penisson | |
| 7,753,124 | B1 * | 7/2010 | Penisson | 166/311 |
| 7,789,154 | B2 * | 9/2010 | Davis | 166/312 |
| 7,806,203 | B2 | 10/2010 | Krueger et al. | |
| 7,861,772 | B2 | 1/2011 | Blair | |
| 7,987,901 | B2 | 8/2011 | Krueger et al. | |
| 8,011,450 | B2 | 9/2011 | Krueger et al. | |
| 8,162,064 | B1 * | 4/2012 | Penisson | 166/368 |
| 8,453,724 | B2 * | 6/2013 | Zhou | 166/99 |
| 8,672,025 | B2 * | 3/2014 | Wolf et al. | 166/99 |
| 2001/0030066 | A1 * | 10/2001 | Clydesdale et al. | 175/339 |
| 2001/0050185 | A1 | 12/2001 | Calder et al. | |
| 2003/0098181 | A1 | 5/2003 | Aronstam et al. | |
| 2004/0251033 | A1 | 12/2004 | Cameron et al. | |
| 2006/0086507 | A1 * | 4/2006 | Surjaatmadja et al. | 166/312 |
| 2010/0243258 | A1 | 9/2010 | Fishbeck et al. | |
| 2010/0258289 | A1 * | 10/2010 | Lynde et al. | 166/55.7 |
| 2010/0258296 | A1 * | 10/2010 | Lynde et al. | 166/105.1 |
| 2010/0258298 | A1 * | 10/2010 | Lynde et al. | 166/173 |
| 2010/0288485 | A1 * | 11/2010 | Blair | 166/99 |
| 2011/0024119 | A1 | 2/2011 | Wolf et al. | |
| 2011/0203848 | A1 | 8/2011 | Krueger et al. | |
| 2012/0118571 | A1 * | 5/2012 | Zhou | 166/301 |
| 2012/0152522 | A1 * | 6/2012 | Lynde | 166/99 |
| 2012/0160503 | A1 | 6/2012 | Davis | |
| 2013/0168091 | A1 | 7/2013 | Xu et al. | |
| 2013/0341027 | A1 * | 12/2013 | Xu et al. | 166/301 |

FOREIGN PATENT DOCUMENTS

| | | |
|---|---|---|
| WO | WO 99/22112 | 5/1999 |
| WO | WO 00/04269 | 1/2000 |
| WO | WO 00/08295 | 2/2000 |
| WO | WO 03/006778 A1 | 1/2003 |
| WO | WO 03/025336 A1 | 3/2003 |

OTHER PUBLICATIONS

Dictionary definition of "barrier" accessed Sep. 5, 2014 via thefreedictionary.com.*

Don M. Hannegan, et al., Technologies Manage Well Pressures, The American Oil & Gas Reporter, Sep. 2001, pp. 87-93, National Publishers Group Inc., U.S.A.

Anthony Hill and William Furlow, New Tool Addresses ECD Problem, Offshore, Jun. 2002, pp. 88-89, U.S.A., retrieved May 14, 2012, from http://www.pennenergy.com/index/petroleum/display/149477/articles/offshore/volume-62/issue-6/departments/drilling-production/new-tool-addresses-ecd-problem.html, pp. 1-3.

P.A. Bern, et al., A New Downhole Tool for ECD Reduction, Feb. 19, 2003, pp. 1-4, SPE/IADC 79821, Society of Petroleum Engineers Inc., U.S.A.

Sven Krüger, TurboLift Advanced ECD Control, Apr. 2005, pp. 1-13, Baker Hughes Incorporated/INTEQ, U.S.A.

* cited by examiner

DOWNHOLE DEBRIS REMOVAL TOOL CAPABLE OF PROVIDING A HYDRAULIC BARRIER AND METHODS OF USING SAME

BACKGROUND

1. Field of Invention

The invention is directed to a downhole clean-up tool or junk basket for use in oil and gas wells, and in particular, to downhole clean-up tools that are capable of creating a hydraulic barrier within the wellbore annulus above the collection member to facilitate capture of debris flowing within the wellbore annulus.

2. Description of Art

Downhole tools for clean-up of debris in a wellbore are generally known and are referred to as "junk baskets." In general, the junk baskets have a screen or other structure that catches debris as debris-laden fluid flows through the screen of the tool. Generally, this occurs because at a point in the flow path, the speed of the fluid carrying the debris decreases such that the junk or debris falls out of the flow path and into a basket or screen.

SUMMARY OF INVENTION

Broadly, downhole tools for clean-up of debris within a well comprise a mandrel and a collection member for capturing debris within the wellbore. A fluid flow member for creating a hydraulic barrier above an opening of the collection member is operatively associated with the mandrel. Creation of the hydraulic barrier facilitates movement of the debris laden fluid within the wellbore into the collection member by restricting upward movement of the debris laden fluid. In one particular embodiment, the fluid flow member includes one or more ports disposed above the opening of the collection member, at least one of the ports being oriented to expel a fluid flowing down the bore of the mandrel into the wellbore annulus to create the hydraulic barrier.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
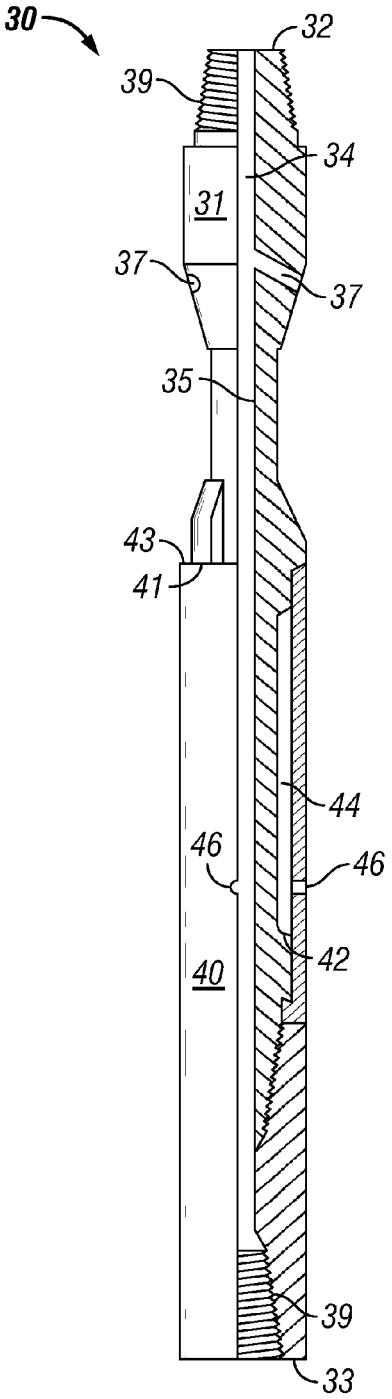
FIG. 1 is a partial cross-sectional view of a specific embodiment of a downhole tool disclosed herein.
Figure 2:
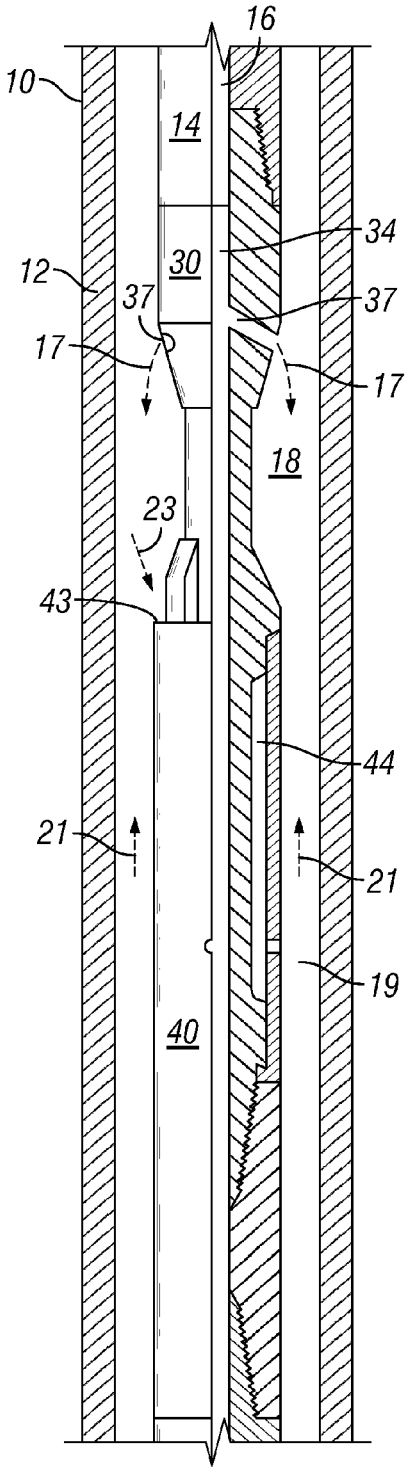
FIG. 2 is a partial cross-sectional view of the downhole tool shown in FIG. 1 disposed in a tool string and disposed in a wellbore.

Referring now to FIGS. 1-2, in one particular embodiment, downhole tool 30 comprises mandrel or body 31 having upper end 32, lower end 33, and bore 34 defined by inner wall surface 35. Both upper and lower ends 32, 33 include threads 39 for releasably connecting downhole tool 30 within a tool or work string (not shown in FIG. 1). Bore 34 runs the entire longitudinal length of body 31. Bore 34 permits a fluid flowing down the tool string to pass through downhole tool 30 where it can ultimately be expelled from the tool string into the wellbore to facilitate a downhole operation such as milling. Upon being expelled into the wellbore, the fluid travels up the wellbore annulus carrying debris so that it can be captured by downhole tool 30.

Downhole tool 30 captures the debris within collection member 40. As shown in the embodiment of FIGS. 1-2, collection member 40 included upper end 41 and lower end 42. Upper end 41 includes one or more openings 43 for receiving debris laden fluid. Lower end 42 is closed so that debris is captured within cavity 44. One or more ports 46 are disposed around collection member 40 to permit fluid and small debris to flow out of cavity 44. Thus, port(s) 46 facilitate circulation of debris laden fluid into and out of cavity 44 so that debris that is too large to pass through port(s) 46 is captured within cavity 44.

To facilitate capturing debris within cavity 44, downhole tool 30 includes one or more fluid flow members to create a hydraulic barrier within the wellbore annulus above opening (s) 43. Creation of the hydraulic barrier restricts the upward movement of the debris laden fluid within the wellbore annulus. As a result, more debris laden fluid is directed into opening(s) 43 so that debris can be captured within cavity 44. In the embodiment of FIGS. 1-2, the fluid flow member that creates the hydraulic barrier is one or more ports 37. Port(s) 37 are in fluid communication with bore 34 so that a portion of the fluid flowing through bore 34 is directed out of port(s) 37 into the wellbore annulus.

Although each port 37 can be shaped and sized as desired or necessary to create the hydraulic barrier, in certain embodiments, one or more of ports 37 include a jet nozzle to facilitate creation of the hydraulic barrier. In addition, one or more of ports 37 can be disposed at an angle that is perpendicular to a longitudinal axis of downhole tool 30. Alternatively, one or more ports 37 can be disposed at an acute angle, oriented in a downward direction such as shown in FIGS. 1-2.

Referring now to FIG. 2, in operation, downhole tool 30 is placed in tool string 14 and lowered to the desired location within casing 12 of wellbore 10. A fluid is flowed or pumped down tool string bore 16 into mandrel bore 34. A portion of the fluid flowing through mandrel bore 34 is directed through ports 37 into wellbore annulus portion 18 as indicated by arrows 17. Additional fluid continues down bore 34, and thus tool string 14 until it is ultimately expelled from tool string 14 into the wellbore. Upon being expelled into the wellbore, the fluid travels up wellbore annulus portion 19 carrying debris as indicated by arrows 21. Upon encountering the hydraulic barrier created by fluid flowing out of ports 37 (arrows 17), the debris laden fluid flowing up through wellbore annulus portion 19 is restricted from flow further up wellbore annulus portion 18, or above wellbore annulus portion 18. As a result, the debris laden fluid is directed toward opening 43 of collection member 40 as indicated by arrow 23.

It is to be understood that the invention is not limited to the exact details of construction, operation, exact materials, or embodiments shown and described, as modifications and equivalents will be apparent to one skilled in the art. For example, the port(s) 37 can be disposed perpendicular to an axis of the downhole tool or they can be disposed at any other angle desired or necessary to create the hydraulic barrier within the wellbore annulus. Further, it is to be understood that the term "wellbore" as used herein includes open-hole, cased, or any other type of wellbores. In addition, the use of the term "well" is to be understood to have the same meaning as "wellbore." Moreover, in all of the embodiments discussed herein, upward, toward the surface of the well (not shown), is toward the top of Figures, and downward or downhole (the direction going away from the surface of the well) is toward the bottom of the Figures. However, it is to be understood that the tools may have their positions rotated in either direction any number of degrees. Accordingly, the tools can be used in any number of orientations easily determinable and adaptable to persons of ordinary skill in the art. Accordingly, the invention is therefore to be limited only by the scope of the appended claims.

What is claimed is:

1. A downhole tool for capturing debris within an annular space, defined between an outermost surface of the tool and a wall defining the surrounding wellbore, the downhole tool comprising:

a mandrel having an upper end, a lower end, a mandrel bore defined by a mandrel inner wall surface and at least one port extending from said bore on said inner wall surface to an outermost wall surface of the tool such that flow through said port creates a hydraulic barrier in the annular space; and a collection member disposed along said outermost wall surface of the tool, the collection member comprising an opening in said annular space and a cavity in fluid communication with the opening, wherein said hydraulic barrier is disposed above the opening of the collection member to redirect debris in flow, which has passed from said upper end without debris, through said mandrel bore and into the annular space while picking up debris in the annular space, into said opening of said collection member.

2. The downhole tool of claim 1, wherein said at least one port comprises a plurality of ports in fluid communication with the mandrel bore.

3. The downhole tool of claim 2, wherein each of the plurality of ports comprise a jet nozzle.

4. The downhole tool of claim 3, wherein each of the plurality of ports is oriented at an acute downward angle relative to a longitudinal axis of the mandrel.

5. The downhole tool of claim 1, wherein:

said collection member further comprises at least one aperture into said annular space.

6. A downhole tool for capturing debris within an annular space in a wellbore, the downhole tool comprising:

a mandrel having an upper end, a lower end, a mandrel bore defined by a mandrel inner wall surface and at least one port extending from said bore on said inner wall surface to an outer wall surface of said mandrel such that flow through said port creates a hydraulic barrier in the annular space; and a collection member disposed along said outer wall surface of the mandrel, the collection member comprising an opening and a cavity in fluid communication with the opening, wherein said hydraulic barrier is disposed above and adjacent the opening of the collection member such that the hydraulic barrier is created above the opening of the collection member to redirect flow, which has passed through said mandrel bore and into the annular space while picking up debris, into said opening of said collection member;

wherein the port is oriented at an acute downward angle relative to a longitudinal axis of the mandrel.

7. The downhole tool of claim 6, wherein the port comprises a jet nozzle.

8. A method of removing debris from a wellbore fluid using a tool, the method comprising the steps of:

(a) flowing a fluid through from one end to another end of a bore of a mandrel;

(b) creating a hydraulic barrier within a wellbore annulus, defined as between an outermost wall of the tool and the wall that defines the wellbore, with laterally diverting at least some of said fluid flowing through said bore;

(c) flowing a debris laden fluid upward within the wellbore annulus until it engages the hydraulic barrier;

(d) directing the debris laden fluid into a collection member having an opening in said wellbore annulus by engaging the debris laden fluid with the hydraulic barrier in said wellbore annulus; and (e) capturing within the collection member through said opening at least one piece of debris from the debris laden fluid flowing in said wellbore annulus.

9. The method of claim 8, wherein during step (b) a portion of the fluid is flowed out of the bore of the mandrel and into the wellbore annulus by passing the portion of the fluid through at least one port disposed within the mandrel and in fluid communication with the bore of the mandrel.

10. The method of claim 8, wherein the hydraulic barrier is created above the collection member.

* * * * *